United States Patent [19]

Tilsley et al.

[11] Patent Number: 4,817,355

[45] Date of Patent: Apr. 4, 1989

[54] WALL CONSTRUCTION

[75] Inventors: Stephen R. Tilsley; Ian P. MacCarthy, both of Birmingham, England

[73] Assignee: Metsec plc, West Midlands, England

[21] Appl. No.: 54,377

[22] Filed: May 26, 1987

[30] Foreign Application Priority Data

Jun. 13, 1986 [GB] United Kingdom ..... 8614425

[51] Int. Cl.[4] ..... E04G 21/00

[52] U.S. Cl. ..... 52/407; 52/408; 52/410; 52/580; 52/317

[58] Field of Search ..... 52/404, 406, 407, 410, 52/580, 480, 481, 454, 483, 785, 809, 792, 317

[56] References Cited

U.S. PATENT DOCUMENTS

| | | | |
|---|---|---|---|
| 2,104,550 | 1/1938 | Bates | 52/580 |
| 3,001,613 | 9/1961 | McBerty | 52/580 |
| 3,654,067 | 4/1972 | Klein | 52/785 X |
| 4,488,390 | 12/1984 | Mulford | 52/407 |
| 4,558,552 | 12/1985 | Reitter, II | 52/410 X |

FOREIGN PATENT DOCUMENTS

| | | | |
|---|---|---|---|
| 1081647 | 5/1960 | Fed. Rep. of Germany | 52/580 |

*Primary Examiner*—David A. Scherbel
*Assistant Examiner*—Richard E. Chilcot, Jr.
*Attorney, Agent, or Firm*—Trexler, Bushnell, Giangiorgi & Blackstone, Ltd.

[57] ABSTRACT

A wall construction comprising a plurality of interconnected rectangular metal frame assemblies, each frame assembly including metal studs of channel section secured together to form the rectangular frame. A rectangular panel of G.R.C. or the like is secured to the outer face of the frame, and a thermal insulation layer is provided on the outer face of said panel. The wall construction further comprises an inner wall lining of plasterboard or the like on the inner face of the frame assemblies and an external skin at the outer face of the thermal insulation layers of the frame assemblies. The invention further resides in a frame assembly for use in such a wall construction.

10 Claims, 1 Drawing Sheet

WALL CONSTRUCTION

Figure 1:
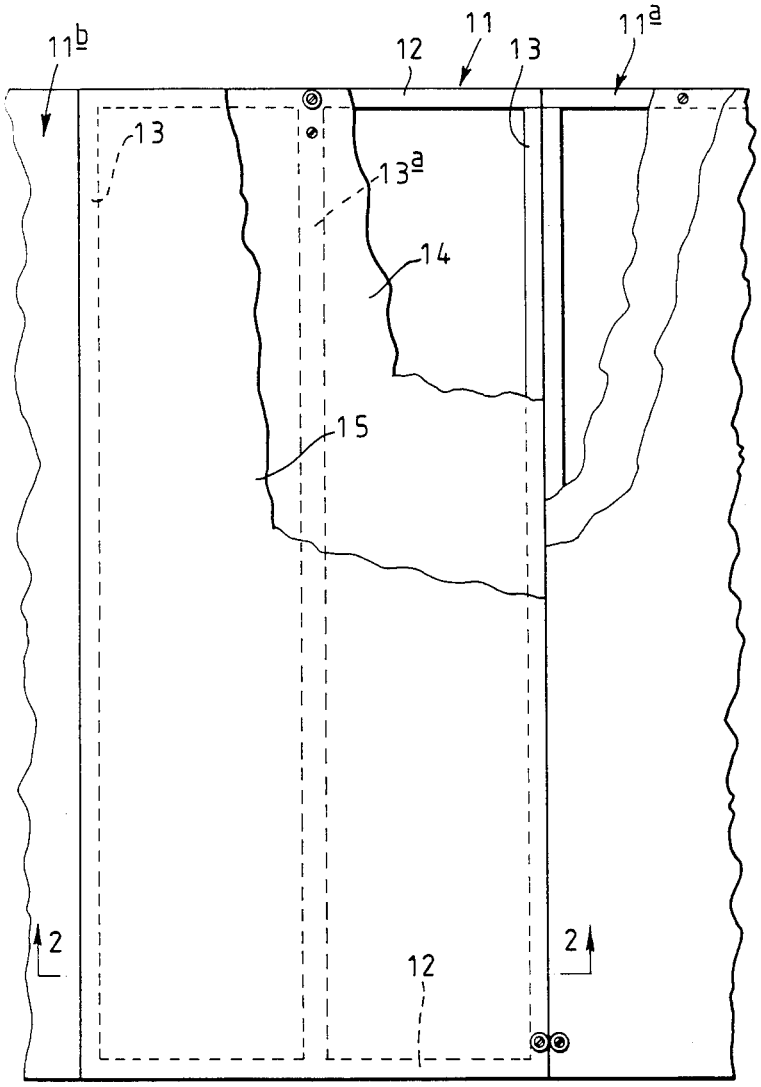

This invention relates to a wall construction for use in metal framed structures, for example structures such as buildings.

A previously proposed wall construction of a metal framed structure comprises a plurality of rectangular metal frame assemblies each assembly including cold formed channel section studs secured together with their open faces presented towards one another to form the rectangular frame, a rectangular "weather-board" panel of suitable material such as glass reinforced cement (G.R.C.) secured to the outer face of the frame, and a heat insulating infill occupying the void bounded by the studs. The heat insulating infill may be a layer of heat insulating material such as mineral wool. A plurality of such frame assemblies are secured together to form an external wall with their G.R.C. panels presented outwardly. The wall construction is completed by an external skin which may be facing brick, a lightweight cladding such as steel, aluminium, or glass reinforced plastic (G.R.P.) or by a render applied directly onto the G.R.C. panels. The inner face of the wall is lined with plasterboard.

A disadvantage of such wall constructions is that the metal studs can effect "cold bridging" between the external and internal wall surfaces and can thus promote interstitial condensation which carries with it the risk of corrosion of the studs and consequential loss of load bearing capacity.

It has been proposed to mitigate the "cold bridging" problems by providing a wall construction wherein heat insulating material is positioned directly on the outer face of the metal frame but it has been found that such a construction cannot meet the required one hour fire rating tests without utilizing a multiplicity of layers of plasterboard or the like as the inner lining of the wall construction it being recognised that it is the inner lining which is exposed to the fire during testing. It is an object of the present invention to provide an improved wall construction, and a frame assembly for use in such a construction, wherein the aforementioned problems are minimised.

A wall construction in accordance with the present invention comprises a plurality of interconnected rectangular metal frame assemblies each frame assembly including metal studs of channel section secured together to form the rectangular frame, a rectangular panel secured to the outer face of the frame and adapted to act as a heat sink for the frame, and a thermal insulation layer on the outer face of said panel, the wall construction further comprising an inner wall lining of plasterboard or the like on the inner face of the frame assemblies and an external skin at the outer face of the thermal insulation layers of the frame assemblies.

Preferably said heat sink panel is a mineral based composition.

Desirably said heat sink panel is formed from G.R.C.

Conveniently, said external skin is spaced from the thermal insulation layers of said assemblies.

Desirably sealing means is interposed between the mutually presented, vertical edge surfaces of adjacent frame assemblies.

The invention further resides in a frame assembly for use in the wall construction as specified in the preceding paragraph, the frame assembly comprising a rectangular metal frame defined by metal channel section studs secured together, a rectangular panel secured to one face of the frame and adapted to act as a heat sink for the frame, and a thermal insulation layer on the outer face of said panel.

Preferably said heat sink panel is a mineral based composition, desirably G.R.C.

It will be recognised that in the wall construction specified above the "weather-board" panel of G.R.C. or the like lies between the exterior surface of the metal frame and the thermal insulation layer. Tests have indicated that such a construction can achieve the required one hour fire rating without the need for multiple plasterboard layers as the inner lining of the wall construction or the use of additional insulation to protect the metal studs.

Preferably the thermal insulation layer has a coating on at least one face thereof constituting a vapour barrier.

Desirably the coating is a layer of aluminium or aluminium alloy foil.

Figure 2:
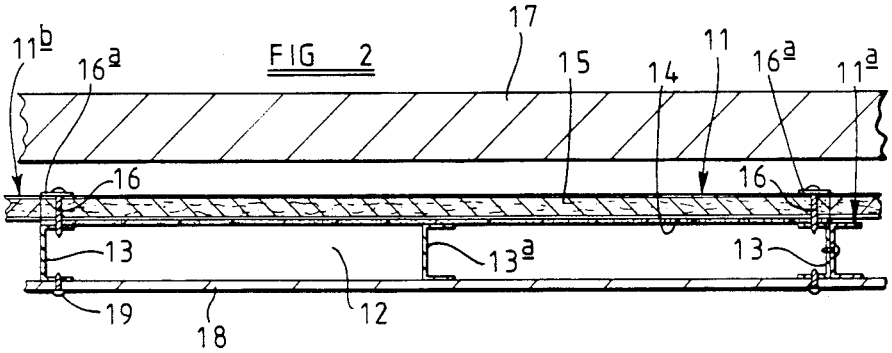

One example of the invention is illustrated in the accompanying drawings wherein:

FIG. 1 is a diagramatic front elevational view of part of a wall construction, and FIG. 2 is a sectional view on the line 2—2 in FIG. 1.

Referring to the drawings, the wall construction, which may be the wall of a multi-storey building or similar structure consists of a plurality of frame assemblies which are preformed, conveniently in the factory and are then assembled on-site. Each frame assembly includes a metal frame consisting of at least four elongate studs, preferably of cold formed steel, each stud being of rectangular channel section and being suitably surface treated to resist corrosion, for example by being galvanised. The studs are secured together with their open faces presented towards one another, to form the rectangular frame, and in FIG. 1 there is shown a frame assembly 11 having upper and lower horizontal studs 12 and vertical studs 13. It will be seen that the frame has an intermediate vertical stud 13*a* which is provided where the horizontal studs 12 exceed a predetermined length. The studs are secured together by welding or by riveting. Self tapping screws or the like (not shown) secure a "weather-board" panel 14 to the face of the studs of the frame which will be outermost in use. The panel 14 is rectangular, and is of dimensions equal to the frame, thus overlying the frame. A thermally insulating board 15 equal in size to the panel 14 overlies the outer face of the panel 14 and is secured through the panel 14 to the studs 12, 13, 13*a* by means of self-drilling, self-tapping screws 16. The thermally insulating board 15 will generally be of a crushable nature, and thus load spreading plates or washers 16*a* are interposed between the board and the heads of the screws 16. A series of frame assemblies each consisting of the metal stud frame, a panel 14 and a board 15, preassembled off-site (conveniently factory assemblied) are secured together to constitute the main load bearing part of the wall construction. In the drawings adjacent frame assemblies are indicated at 11*a* and 11*b* respectively and it will be recognised that other frame assemblies may be positioned vertically on top of the frame assemblies 11, 11*a*, 11*b* to produce a wall construction of desired height.

In order to ensure that the thermally insulating boards 15 are protected the wall construction includes an external skin 17 which is not normally intended to be part of the load bearing structure. The skin 17 can take a wide variety of different forms ranging from a simple waterproof and abrasion resistant coating or rendering on the exterior of the boards 15, through various cladding such as steel, aluminium and G.R.P., to a facing brick layer of a predetermined decorative appearance, a ventilated cavity being defined between the boards 15 and the cladding or facing brick layer if desired. The internal face of the frame assemblies 11 is covered by a plasterboard lining 18 which conveniently is secured to the studs of the frame assemblies by self tapping screws 19. The sheets of plasterboard, conveniently "Fireline" board manufactured by British Gypsum Limited, forming the lining 18 are arranged so that their boundaries do not coincide with the boundaries of the frame assemblies in order to improve the fire resistance of the wall construction.

It is found that light-weight studs (of sufficient strength to achieve the necessary load bearing characteristics) can be utilized in such a wall construction with a single plasterboard layer forming the interior lining while still achieving the necessary one hour fire rating. It is believed that this improved fire rating performance is attributable to the arrangement of the "weather-board" panel between the studs and the thermal insulation layer 15, the "weather-board" panel 14 acting as a heat sink for the studs of the frame assembly thus minimising the temperature rise of the studs during the fire rating test period. Preferably the panels 14 are formed from glass reinforced cement, although other like materials such as plasterboard, "TUNNEL IMPACT" board, "TEMEC" board, "MINERIT" board, and "SUPERLUX" board would be suitable. All of the above boards are mineral based boards having a thermal capacity and conductivity which is suitable for action of the board as a heat sink protecting the studs against excessive temperature rise when subjected to fire testing. Clearly wood or paper based boards such as fibre boards would not be suitable. It should be noted that the "weather-board" panel 14 exhibits heat sink properties, but is not intended significantly to contribute to the load bearing strength of the frame assembly.

The thermally insulating board 15 of each frame assembly can take a number of forms but is conveniently Celotex double R thermal sheathing "CELOTEX R. R." board. The board 15 also is not intended to contribute to the load bearing properties of the frame assembly, but its presence is important provide the wall construction with an acceptable thermal insulation value (U value) to conform to Building regulations, and to minimise condensation within the frame assemblies. The risk of such condensation (known as interstitial condensation) is significant with metal framed wall constructions since the metal studs give rise to extensive "cold-bridging" and of course interstitial condensation carries with it the risk of corrosion of the metal studs with consequential loss of load bearing capacity.

It should be recognised that FIGS. 1 and 2 are not drawn to scale. In an example of the wall construction described above the outer skin 17 has a thickness of 100 mm and a gap of 50 mm exists between the skin 17 and the board 15. The board 15 is 35 mm thick and the "weather-board" panel 14 is 8 mm thick. The width of the studs **12, 13, 13*a* (measured across the web) is 75 mm and the plasterboard lining 18 is "Fireline" board approximately 10 mm thick. The washers 16*a* are of 50 mm diameter and the screws 16 also hold spacers or clips which project forwardly from the board 15 to locate the cladding forming the skin 17**. Each frame assembly is 2.7 m high and 1.2 m wide although 600 mm (half width) frames assemblies can be utilized. Such half with frame assemblies do not incorporate a central vertical stud. Moreover the frame assembly height can be chosen from a range of heights to suit the particular application, and studs of greater size can be used where higher load bearing requirements are to be met (for example channel section of 100 mm with increased flange width could be used). Approximately dimensioned infill frame assemblies can be constructed to match with window and door frames to achieve a standard modular construction.

The board 15 of each frame assembly 11 has a vapour barrier in the form of a layer of aluminium or aluminium alloy foil on both faces. The innermost foil layer is of course protected during building by being presented to the board 14. This is important since it ensures that the inner vapour barrier is complete and not susceptible to damage during handling of the frame assemblies. Any damage to the outer foil layer can be readily seen and thus can readily be repaired at a convenient point in the building work. One or more neoprene sealing strips are interposed between the mutually presented vertical studs of adjacent frame assemblies and where desired the edges of boards 15 can be covered with foil tape adhesively secured in position. Such tapes will be used at horizontal abutting edges where frame assemblies are positioned one above the other. Vapour barriers other than metal foil can be utilized if desired.

We claim:

1. A wall construction comprising a plurality of interconnected metal frame assemblies, said assemblies providing an inner face, each frame assembly including metal studs of channel section secured together to form a rectangular frame having an outer face, a rectangular panel secured to said outer face and having sufficient thermal capacity and conductivity for acting as a heat sink for the frame for reducing rate of temperature rise in the frame when the frame is subjected to heat from a fire or the like, said panel having an outer face, and a thermal insulation layer on the outer face of said panel, said thermal insulation layer having an outer face, the wall construction further comprises an inner wall lining on the inner face of the frame assemblies, and an external skin at the outer face of the thermal insulation layers of the frame assemblies.

2. A wall construction as claimed in claim 1 wherein said heat sink panel is a mineral based composition.

3. A wall construction as claimed in claim 2 wherein said heat sink panel is formed from G.R.C.

4. A wall construction as claimed in claim 1 wherein said external skin is spaced from the thermal insulation layers of said assemblies.

5. A wall construction as claimed in claim 1 wherein sealing means is interposed between the mutually presented, vertical edge surfaces of adjacent frame assemblies.

6. A frame assembly for use in a wall construction, the frame assembly comprising a rectangular metal frame defined by metal channel section studs secured together, a rectangular panel secured to one face of the frame and having sufficient thermal capacity and conductivity for acting as a heat sink for the frame, and a thermal insulation layer on the outer face of said panel.

7. A frame assembly as claimed in claim 6 wherein said heat sink panel is a mineral based composition.

8. A frame assembly as claimed in claim 7 wherein said heat sink panel is formed from G.R.C.

9. An assembly as claimed in claim 4 wherein the thermal insulation layer has a surface coating, at least on one face, constituting a vapour barrier.

10. An assembly as claimed in claim 9 wherein said coating is a layer of aluminium or aluminium alloy foil.

* * * * *